US009514900B2

(12) United States Patent
Park

(10) Patent No.: US 9,514,900 B2
(45) Date of Patent: Dec. 6, 2016

(54) INPUT BUTTON ASSEMBLY

(71) Applicant: Samsung Electronics Co., Ltd., Gyeonggi-do (KR)

(72) Inventor: Hae Sung Park, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/669,236

(22) Filed: Mar. 26, 2015

(65) Prior Publication Data

US 2015/0279589 A1 Oct. 1, 2015

(30) Foreign Application Priority Data

Mar. 28, 2014 (KR) ..... 10-2014-0036610

(51) Int. Cl.

| | |
|---|---|
| ***H01H 21/24*** | (2006.01) |
| ***H01H 13/14*** | (2006.01) |
| ***H01H 21/86*** | (2006.01) |
| ***H01H 13/18*** | (2006.01) |
| ***H01H 21/06*** | (2006.01) |
| ***H01H 13/7065*** | (2006.01) |

(52) U.S. Cl.

CPC ..... *H01H 13/14* (2013.01); *H01H 13/186* (2013.01); *H01H 13/7065* (2013.01); *H01H 21/06* (2013.01); *H01H 21/24* (2013.01); *H01H 21/86* (2013.01); *H01H 2223/002* (2013.01); *H01H 2225/028* (2013.01); *H01H 2231/022* (2013.01); *H01H 2237/004* (2013.01)

(58) Field of Classification Search

CPC ..... H01H 13/186; H01H 21/86; H01H 21/06; H01H 21/24

USPC ..... 200/520, 341, 343, 330, 513

See application file for complete search history.

(56) References Cited

U.S. PATENT DOCUMENTS

| | | | | | |
|---|---|---|---|---|---|
| 4,190,748 | A * | 2/1980 | Langford | B41J 5/12 | 200/275 |
| 4,582,967 | A * | 4/1986 | Brumit | H01H 13/705 | 200/343 |
| 5,545,866 | A * | 8/1996 | Bulin | H01H 13/14 | 200/341 |
| 5,749,457 | A * | 5/1998 | Castaneda | H01H 1/5805 | 200/343 |
| 5,813,520 | A * | 9/1998 | Reier | H01H 21/22 | 200/330 |
| 6,034,340 | A * | 3/2000 | Aoki | H01H 13/705 | 200/314 |

(Continued)

FOREIGN PATENT DOCUMENTS

| | | |
|---|---|---|
| JP | 2012-28175 A | 2/2012 |
| KR | 10-2013-0128155 A | 11/2013 |

*Primary Examiner* — Felix O Figueroa
(74) *Attorney, Agent, or Firm* — Cha & Reiter, LLC

(57) ABSTRACT

An electronic device is provided including: a housing having a button hole formed therein: a button disposed in the button hole; a switch having a touch part; and a pressing element interposed between the button and the switch, the pressing element including a first end part contacting a first wall of the housing, a second end part contacting the button, and a pressing projection disposed adjacently to the switch; wherein when the button is actuated, the pressing element pivots upon the second end part in a first direction, while the pressing projection actuates the switch.

20 Claims, 15 Drawing Sheets

(56) References Cited

U.S. PATENT DOCUMENTS

| | | | | |
|---|---|---|---|---|
| 6,593,537 | B2 * | 7/2003 | Teruyama | H01H 13/7006 200/406 |
| 7,381,919 | B1 * | 6/2008 | Yu | H01H 21/24 200/296 |
| 8,835,784 | B2 * | 9/2014 | Hirota | H01H 21/24 200/343 |
| 8,946,575 | B2 | 2/2015 | Kikuchi | |
| 2009/0058811 | A1 | 3/2009 | Lin | |
| 2012/0325637 | A1 | 12/2012 | Kikuchi | |

* cited by examiner

INPUT BUTTON ASSEMBLY

CROSS-REFERENCE TO RELATED APPLICATION

The priority of Korean patent application No. 10-2014-0036610 filed Mar. 28, 2014, the disclosure of which is hereby incorporated in its entirety by reference, is claimed.

BACKGROUND

1. Field of the Disclosure

The present disclosure relates to an electronic devices and more particularly to an input button assembly.

2. Background of the Disclosure

Portable devices may be equipped with buttons, switches, and keys for performing various functions, such as sound volume control. However, due to the limited space in some device enclosures, fitting a key that is sensitive while also providing adequate tactile feedback may be a challenging task. Accordingly, the need exists for new key designs that provide both adequate tactile feedback and sensitivity.

SUMMARY

The present disclosure addresses this need. According to aspects of the disclosure, an electronic device is provided comprising: a housing having a button hole formed therein: a button disposed in the button hole; a switch having a touch part; and a pressing element interposed between the button and the switch, the pressing element including a first end part contacting a first wall of the housing, a second end part contacting the button, and a pressing projection disposed adjacently to the switch; wherein when the button is actuated, the pressing element pivots upon the second end part in a first direction, while the pressing projection actuates the switch.

DETAILED DESCRIPTION

Figure 1:
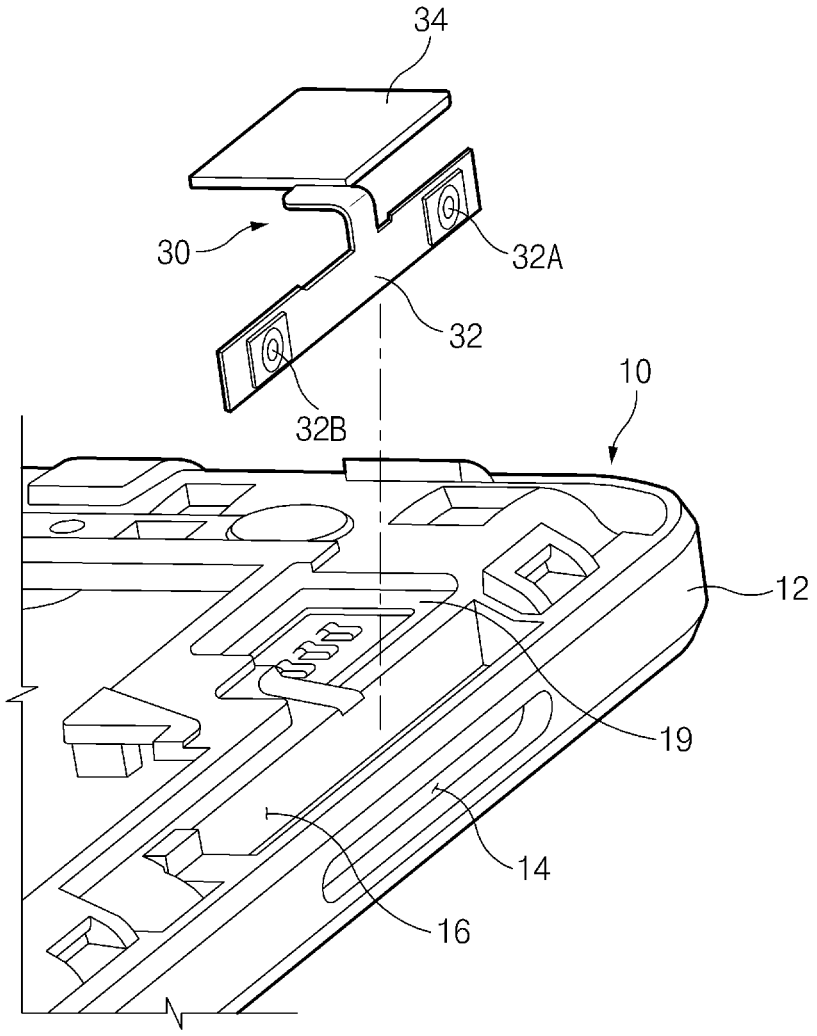
FIG. 1 is a partial exploded perspective view of an example of an electronic device, according to aspects of the disclosure.

Hereinafter, the present disclosure is provided with reference to the accompanying drawings. Various modifications are possible of the examples depicted in the drawings. With respect to the descriptions of the drawings, like reference numerals refer to like elements.

The term "include," "comprise," and "have", or "may include," or "may comprise" and "may have" used herein indicates disclosed functions, operations, or existence of elements but does not exclude other functions, operations or elements. Additionally, in this specification, the meaning of "include," "comprise," "including," or "comprising," specifies a property, a region, a fixed number, a step, a process, an element and/or a component but does not exclude other properties, regions, fixed numbers, steps, processes, elements and/or components.

The meaning of the term "or" used herein includes any or all combinations of the words connected by the term "or". For instance, the expression "A or B" may indicate include A, B, or both A and B.

The terms such as "1st", "2nd", "first", "second", and the like used herein may refer to modifying various different elements, but do not limit the elements. For instance, such terms do not limit the order and/or priority of the elements. Furthermore, such terms may be used to distinguish one element from another element. For instance, both "a first user device" and "a second user device" indicate a user device but indicate different user devices from each other. For example, a first component may be referred to as a second component and vice versa without departing from the scope of the present disclosure.

In this disclosure below, when one part (or element, device, etc.) is referred to as being 'connected' to another part (or element, device, etc.), it should be understood that the former can be 'directly connected' to the latter, or 'electrically connected' to the latter via an intervening part (or element, device, etc.). In contrast, when an element is referred to as being "directly connected" or "directly coupled" to another element, there are no intervening elements present.

Terms used in this specification are used to describe specific examples, and are not intended to limit the scope of the present disclosure. The terms of a singular form may include plural forms unless they have a clearly different meaning in the context.

Unless otherwise defined herein, all the terms used herein, which include technical or scientific terms, may have the same meaning that is generally understood by a person skilled in the art. It will be further understood that terms, which are defined in the dictionary and in commonly used, should also be interpreted as is customary in the relevant related art and not in an idealized or overly formal sense unless expressly so defined.

An electronic device according to aspects of the disclosure may have a communication function. For instance, electronic devices may include at least one of smartphones, tablet personal computers (PCs), mobile phones, video phones, electronic book (e-book) readers, desktop personal computers (PCs), laptop personal computers (PCs), netbook computers, personal digital assistants (PDAs), portable multimedia player (PMPs), MP3 players, mobile medical devices, cameras, and wearable devices (e.g., head-mounted-devices (HMDs) such as electronic glasses, electronic apparel, electronic bracelets, electronic necklaces, electronic accessories, electronic tattoos, and smart watches).

According to aspects of the disclosure, an electronic device may be smart home appliances having a communication function. The smart home appliances may include at least one of, for example, televisions, digital video disk (DVD) players, audios, refrigerators, air conditioners, cleaners, ovens, microwave ovens, washing machines, air cleaners, set-top boxes, TV boxes (e.g., Samsung HomeSync™, Apple TV™ or Google TV™), game consoles, electronic dictionaries, electronic keys, camcorders, and electronic picture frames.

According to aspects of the disclosure, an electronic device may include at least one of various medical devices (for example, magnetic resonance angiography (MRA) devices, magnetic resonance imaging (MRI) devices, computed tomography (CT) devices, medical imaging devices, ultrasonic devices, etc.), navigation devices, global positioning system (GPS) receivers, event data recorders (EDRs), flight data recorders (FDRs), vehicle infotainment devices, marine electronic equipment (for example, marine navigation systems, gyro compasses, etc.), avionics, security equipment, car head units, industrial or household robots, financial institutions' automatic teller's machines (ATMs), and stores' point of sales (POS).

According to aspects of the disclosure, an electronic device may include at least one of furniture or buildings/structures having a communication function, electronic boards, electronic signature receiving devices, projectors, or various measuring instruments (for example, water, electricity, gas, or radio signal measuring instruments). An electronic device according to aspects of the disclosure may be one of the above-mentioned various devices or a combination thereof. Additionally, an electronic device according to aspects of the disclosure may be a flexible device. It is to be understood that the disclosure is not limited to any particular type of electronic device.

Hereinafter, an electronic device according to various aspects of the disclosure will be described in more detail with reference to the accompanying drawings. The term "user" may refer to a person using an electronic device or a device using an electronic device (for example, an artificial intelligent electronic device).

Referring to FIGS. 1 to 5, an electronic device according to aspects of the disclosure may include a housing 10 having a wall 12, an input button 20 inserted into a button hole 14 formed at the wall 12 and pressed, a switch 30 disposed in the housing 10 as being spaced apart from the input button 20, and a pressing element 40 interposed between the input button 20 and the switch 30.

Hereinafter, although in the present example the input button 20 is a side key is, in other implementations the input button 20 may be a front key or a back key. Accordingly, it should be understood that the side key is described on the behalf of various input buttons 20.

In some aspects, when the input button 20 is a side key, the button hole 14 may be a key hole. Accordingly, it is to be understood that the terms "key hole" and "button hole" may be used interchangeably.

In some aspects, the switch 30 may include a touch panel, a pressure sensor, and/or any other suitable type of component that is capable of detecting user input. In the present example, the switch 30 is a dome type switch.

In some aspects, the housing 10 may include a wall 12 and the button hole 14 may be formed at the wall 12 and thus. Although in this example, the wall 12 is a sidewall, in other implementations the wall 12 may be, a front wall, a rear wall, and/or any other suitable type of wall.

In some aspects, a receiving slot 16 receiving the switch 30 and a pressing element 40 may be formed at the inner side of the sidewall 12, and the key hole 14 may be formed of a through hole opened from the receiving slot toward the sidewall 12. Additionally, the key hole 14 may be sized such that a fine gap is formed between the key hole 14 and the side key 20 so as to smoothly push the side key 20 while the side key 20 is inserted into the key hole 14.

The switch 30 may include a dome part 32 and an electrical terminal part 34 for delivering a signal that is generated when the dome part 32 is pressed. The electronic terminal part 34 may deliver the signal to a control unit (not shown) that is part of the electronic device. In some implementations, the dome part 32 may include domes 32A and 32B.

The side key 20 may have a protrusion part 22. The protrusion part 22 may be formed at the center of a surface facing the interior of the electronic device.

Figure 2:
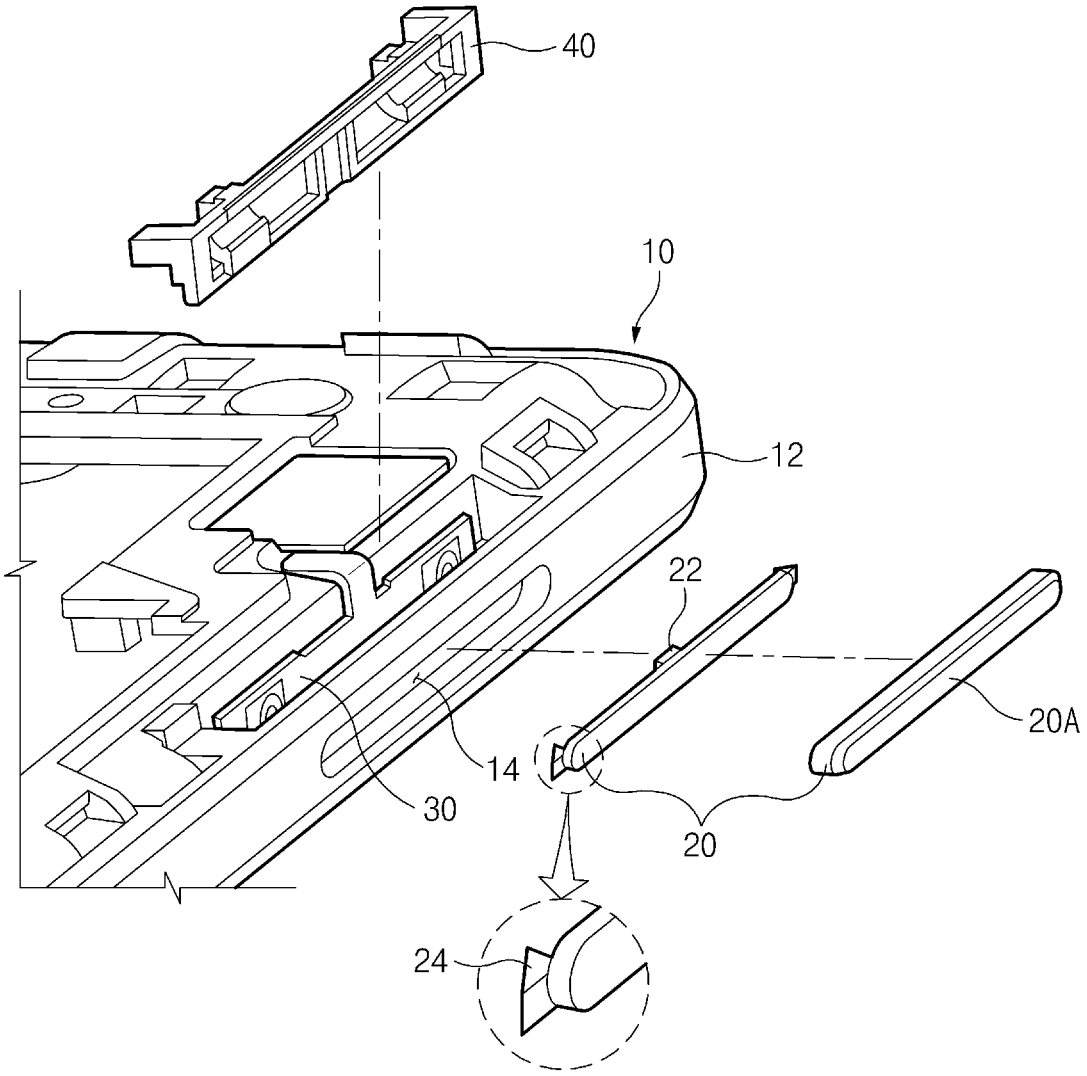
FIG. 2 is a partial exploded perspective view of the electronic device, according to aspects of the disclosure.
Figure 3:
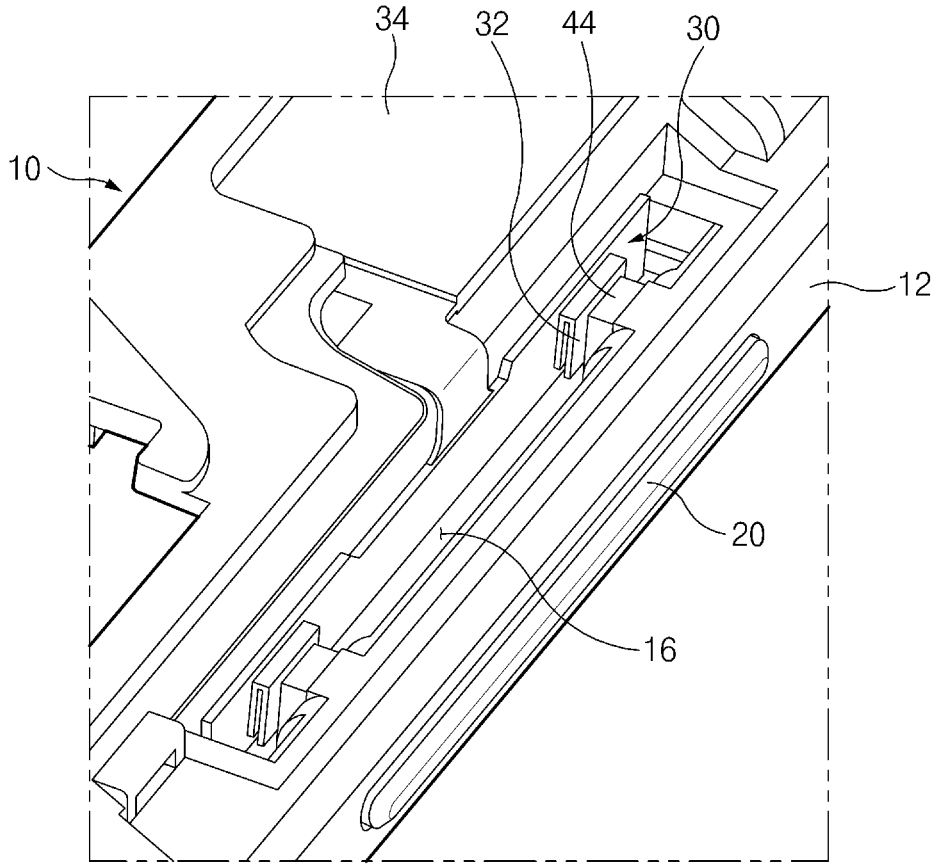
FIG. 3 is a partial perspective view of the electronic device, according to aspects of the disclosure.

The side key 20 may be manufactured by coupling a key cap 20A with a base member, as shown in FIG. 2. The key cap 20A may be facing outside of the electronic device, and the base member may be disposed inside the receiving slot 16. For example, the key cap 20A may be formed of a metallic material such as aluminum and the base member may be formed of a plastic material. However, the side key 20 does not need to be formed by coupling a plurality of such members and may be formed as a single member. Moreover, it is possible to mold a plurality of members as one member through a manufacturing method such as double injection or insert injection.

An elastic hook 24 may be formed at each of the length direction both end parts of the side key 20. The elastic hook 24 may have a wedge shape narrowing from the key hole 14 toward the receiving slot 16.

When the side key 20 has such an elastic hook 24, it may be inserted into the key hole 14 by pressing the side key 20 against the key hole 14 in the direction from the outside of the housing 10 toward the receiving slot 16. Accordingly, the elastic hook 24 may permit the side key 20 to be easily inserted into the key hole 20. In some aspects, both ends of the pressing element 40 may be fixed in the receiving slot 16.

The pressing element 40 may have a support part 42 formed at a position corresponding to the protrusion part 22 of the side key 20 and a pressing projection 44 formed at each side.

The pressing projection 44 may have a convex shape that is oriented toward the dome part 32. On the other hand, a surface facing the side key 20 of the pressings projection 44 may have a concave shape.

Moreover, the pressing element 40 may be formed of an elastic material and it may be manufactured through injection molding. For example, the pressing element 40 may be formed of a polycarbonate material or a polycarbonate material and a urethane material. Additionally or alternatively, the pressing element 40 may be formed of a metallic material such as stainless steel (SUS), and/or any suitable type of material.

In operation, the side key 20 may perform a seesaw movement as a result of the protrusion part 22 being present. Thus, the protrusion part 22 of the side key 20 may function as a fulcrum in close contact with the support part 42 of the pressing element 40. Through this, the length direction both end parts of the side key 20 may selectively press both end parts of the pressing element 40.

Figure 4:
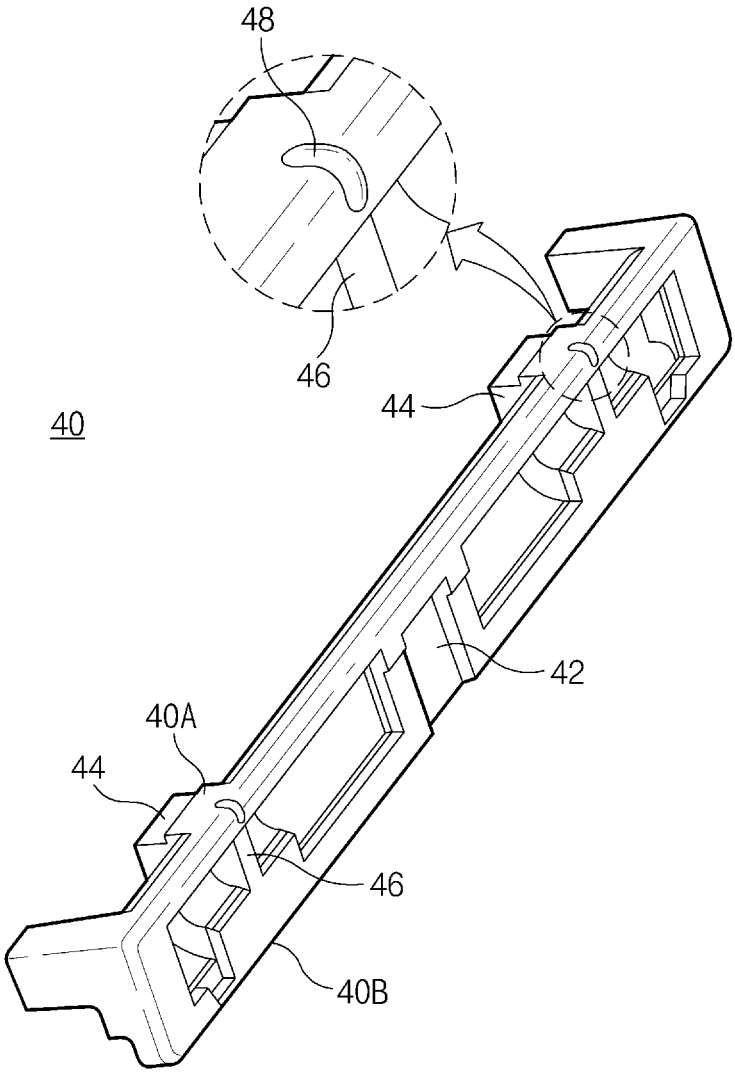
FIG. 4 is a partial perspective view of a pressing element, according to aspects of the disclosure.

With reference to FIG. 4, the second end part 40B contacting the sidewall 12 may pivot upon the first end part 40A when the side key 20 is pressed.

Moreover, a reinforcing rib 46 reinforcing the rigidity of the pressing projection 44 may be formed at a surface facing the sidewall 12 of the housing 10. The reinforcing rib 46 may prevent the pressing projection 44 from being damaged or its elasticity from being lowered due to repeated pressing the side key 20. The reinforcing rib 46 may be formed along a direction connecting the first end part 40A and the second end part 40B.

Figure 5:
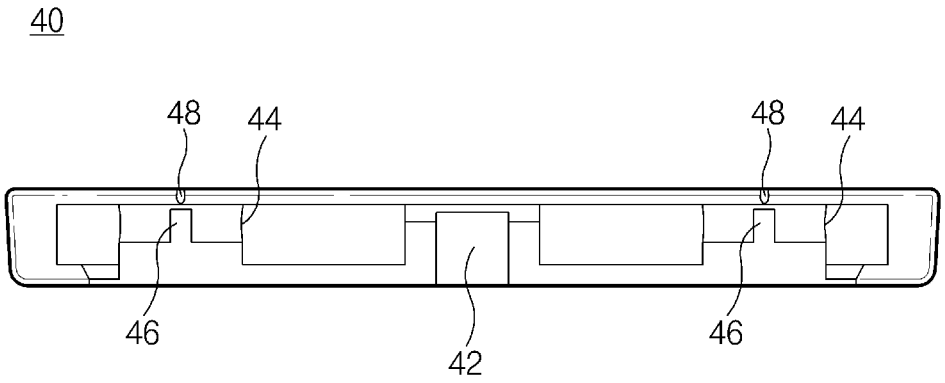
FIG. 5 is an orthographic projection of the pressing element, according to aspects of the disclosure.

Although one reinforcing rib 46 is formed at each pressing projection 44 as shown in FIGS. 4 and 5, the present disclosure is not limited thereto. A plurality of reinforcing ribs 46 may be equipped at each pressing projection 44. Additionally, although in this example, the reinforcing rib 46 is disposed at the middle at the pressing projection, in other implementations, the reinforcing rib 46 may be disposed at an edge portion of the pressing projection 44, or elsewhere.

In some aspects, a rotation center projection 48 protruding toward the sidewall 12 may be formed at the first end part 40A. In some implementations, the surface of the rotation center projection 48 may be curved.

Figure 6:
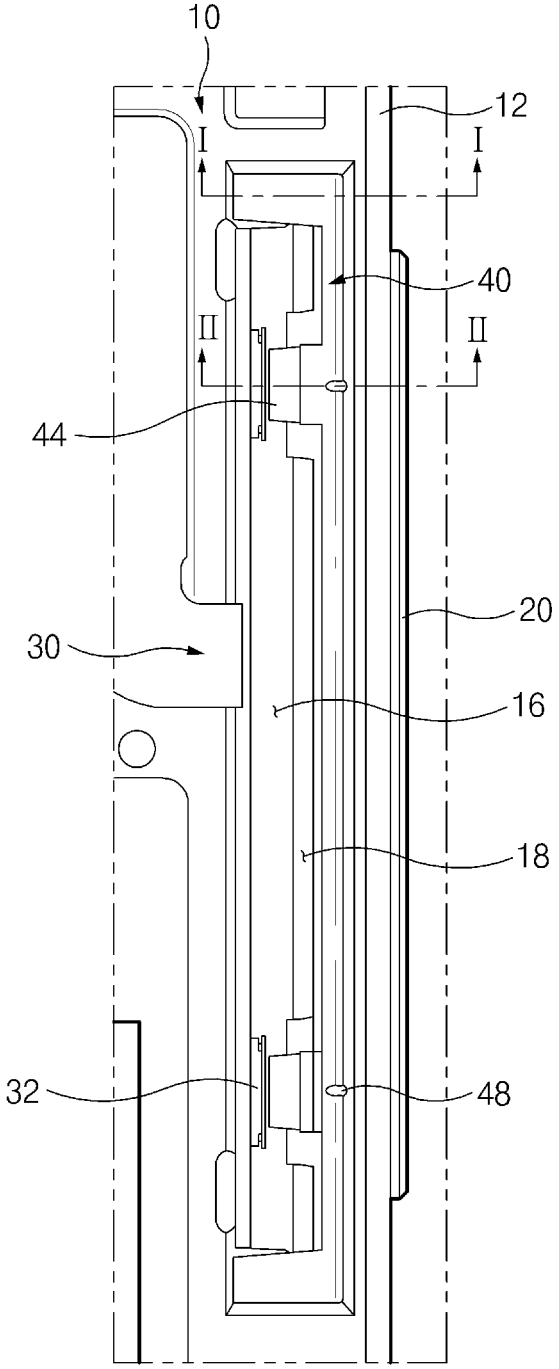
FIG. 6 is a partial plan view of an electronic device, according to aspects of the disclosure.
Figure 7:
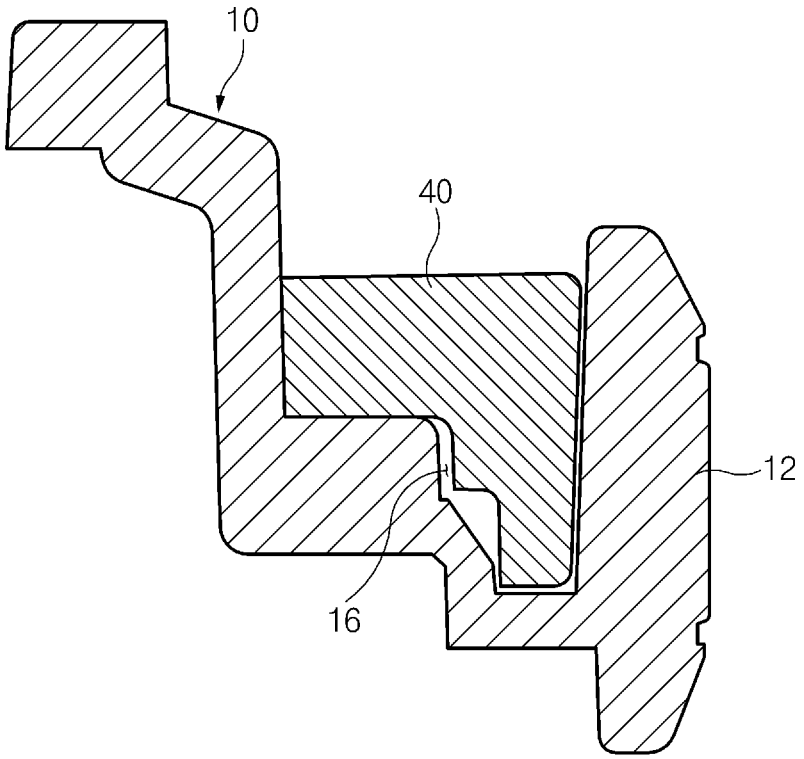
FIG. 7 is a sectional view taken along a line I-I of FIG. 6, according to aspects of the disclosure.
Figure 8:
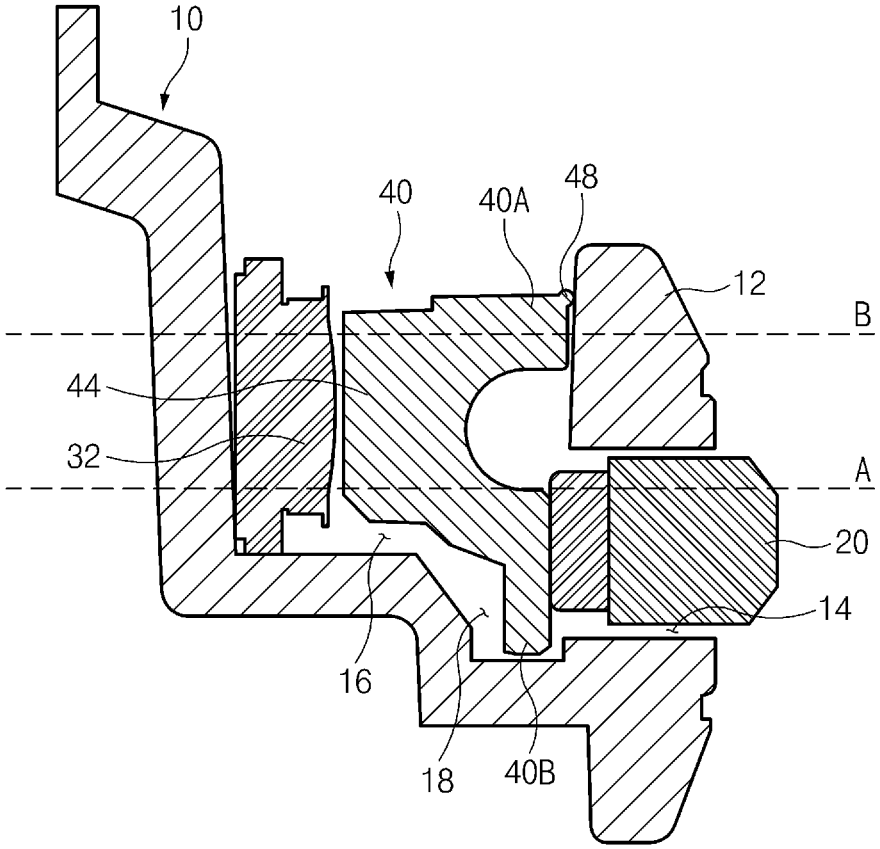
FIG. 8 is a sectional view taken along a line II-II of FIG. 6, according to aspects of the disclosure.

Referring to FIGS. 6-8, the receiving slot 16 may have a receiving groove 18 for receiving the part 40B of the pressing element 40 and limiting a rotating range of the part 40B.

In some aspects, both end parts 16 of the pressing element 40 may be fixed at the receiving slot 16 (see FIGS. 6 and 7). Additionally or alternatively, the pressing projection 44 is movable slightly with a vicinity of the position at which the pressing projection 44 is formed.

In some aspects, with reference to FIG. 8, the receiving groove 18 may be formed at a lower of the receiving slot 16, such that receiving groove 18 is situated near the side key 20. The part 40B of the pressing element 40 may be disposed inside the receiving groove 18.

As shown in FIG. 8, the part 40B of the pressing projection 44 is disposed at the right side of the receiving groove 18 while the side key 20 is in a released state (i.e., not pressed). When the side key 20 is pressed, as shown in FIG. 8, the side key 20 actuates the second end part 40B of the pressing projection 44 when the side key 20 is pressed. The second end part 40B of the pressing projection 44 interoperates with the movement of the side key 20 to move toward the left side in the receiving groove 18.

Moreover, the position of the first end part 40A of the pressing projection 44 is constrained between the dome part 32 and the sidewall 12. When the second end part 40B of the pressing projection 44 moves toward the left side in the receiving groove 18, with reference to FIG. 8, instead of the entire pressing projection 44 moving to the left, the second end part 40B of the pressing projection 44 rotates clockwise about the first end part 40A, with the center projection 48 lying on the axis of rotation of the part 40B. Additionally, when the rotation center projection 48 has a round shape, the rotation of the second end part 40B of the pressing projection 44 may be smoother.

In some aspects, when the side key 20 is pressed, the part 40B may rotate and contact the sidewall 12 of the pressing element 40. Since the pressing element 40 is interposed between the side key 20 and the switch 30, when the second end part 40B is rotated, the dome part 32 may be actuated by the pressing projection 44.

In some aspects, when the key 20 is pressed, it may move along an axis A. However, when the dome part 32 is actuated as a result of the pressing of the key 20, the dome part 32 may move along the axis B. In the present example, the axes A and B are parallel to one another. In some aspects, this arrangement may drastically reduce situations in which the side key 20 is pressed several times in error or situations in which the dome part 32 is not actuated when the side key 20 is pressed.

In some implementations, when the key 20 is in a released state, the position of the first end part 40A of the pressing projection 44 may be constrained between the sidewall 12 and the dome part 32. More particularly, the second end part 40B of the pressing projection 44 may press the side key 20 outwardly (e.g., away from the housing of the electronic device) toward the outside of the housing to hold the side key 20 firmly in place and prevent it from Jittering (or rattling) while the side key 20 is in a released state.

Figure 9:
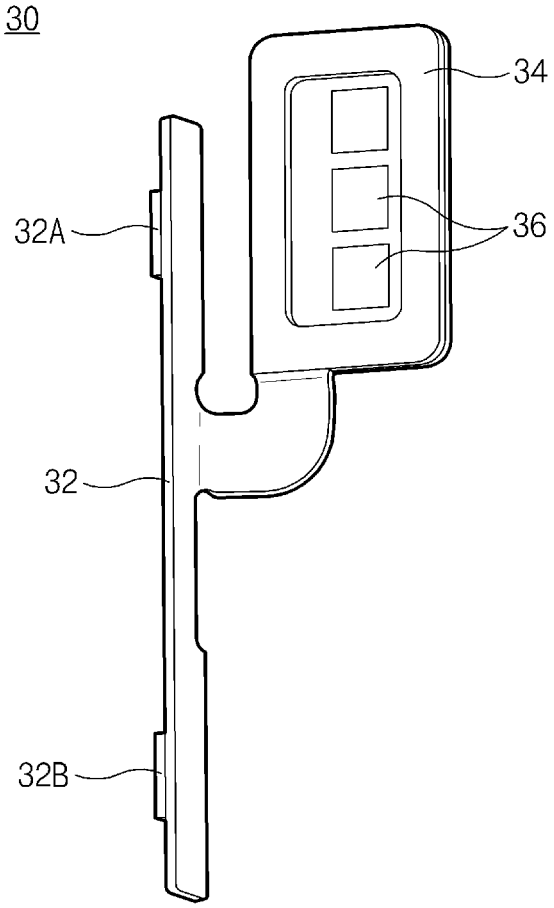
FIG. 9 is an orthographic projection of an example of a switch, according to aspects of the disclosure.
Figure 10:
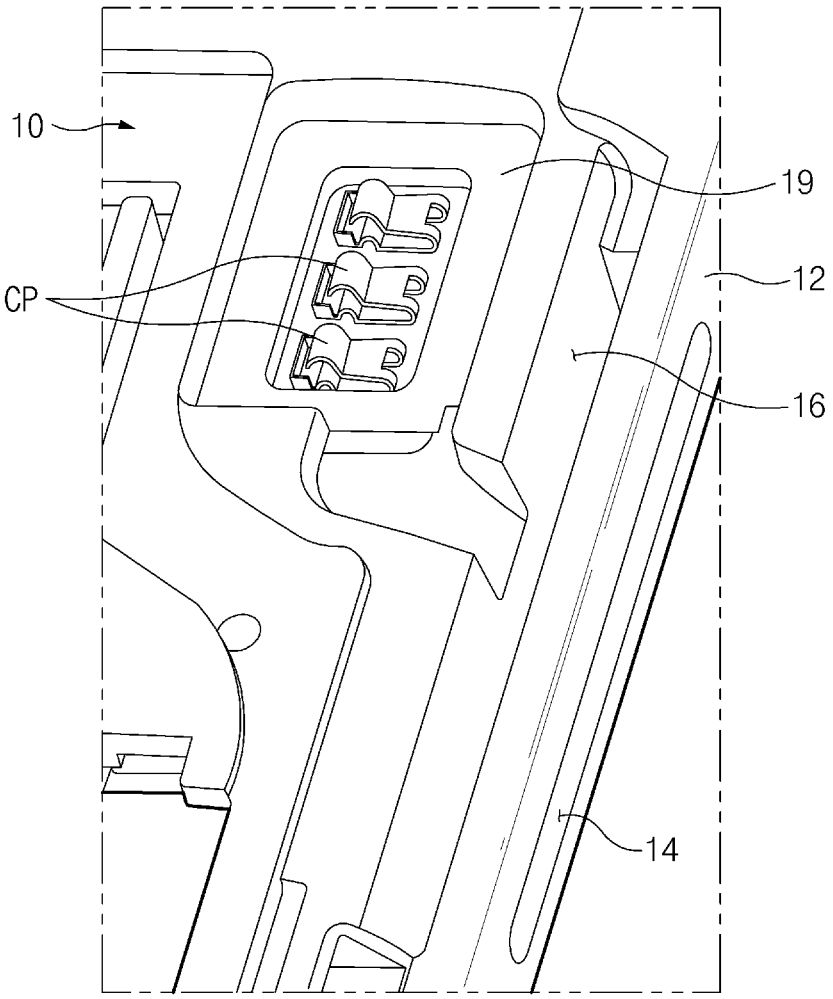
FIG. 10 is a perspective view illustrating an example of a seating base, according to aspects of the disclosure.
Figure 11:
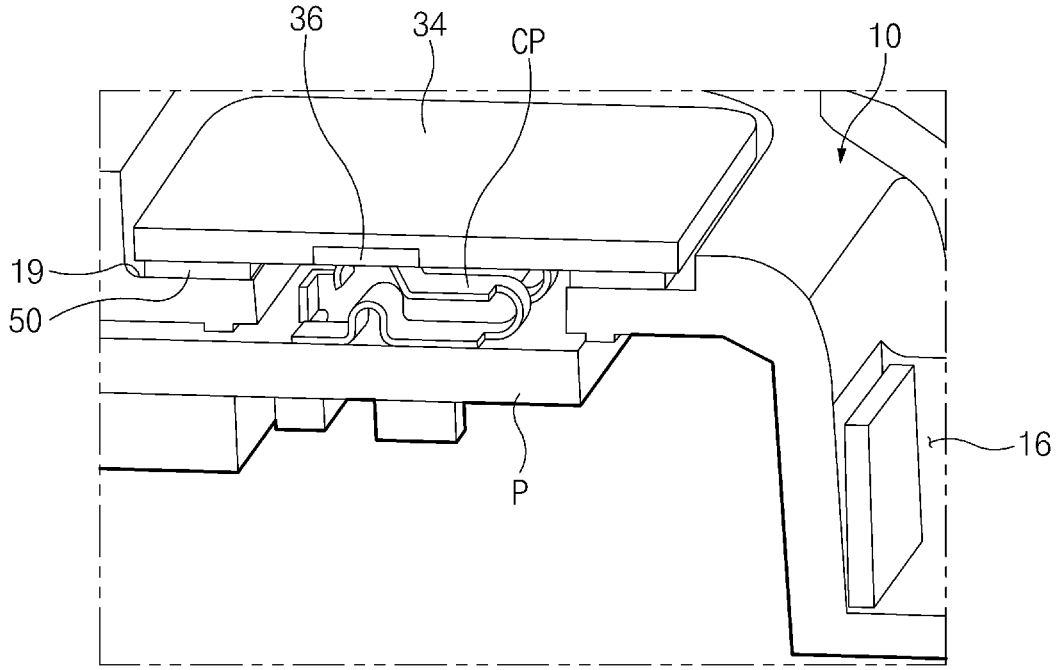
FIG. 11 is a partial cross-sectional view of the electronic device showing a cross-section of the seating base of FIG. 10 and the switch of FIG of FIG. 9, according to aspects of the disclosure.

Referring to FIGS. 9-11, a switch 30 may include a dome part 32 and an electrical terminal part 34. A first contact point 36 may be formed at the electrical terminal part 34.

Moreover, referring to FIG. 10, an electronic device according to aspects of the disclosure may further include a seating base 19 formed adjacently to the receiving slot 16. The electrical terminal part 34 extending from the switch 30 may be seated on the seating base 19.

Once electrical terminal part 34 is seated on the seating base 19, the first contact point 36 formed at the electrical terminal part 34 may contact a second contact point CP exposed toward the seating base 19 (see FIG. 11).

Accordingly, when the dome part 32 is actuated, a signal may flow through the first contact point 36 formed at the electrical terminal part 34 and the second contact point CP connected to the first contact point 36. The signal may be inputted to a control unit (not shown) installed at the electronic device through a PCB P where the second contact point CP is installed.

In some aspects, the edge of the electrical terminal part 34 formed at the switch 30 may be sealed to the seating base 19 (see FIG. 11). A waterproof tape 50 (or any material with a waterproofing function) may be applied to the edge of the electrical terminal part 34. In this case, when the electrical terminal part 34 is attached to the seating base 19, the waterproof tape or the adhesive material may prevent foreign substances such as moisture or dust from entering the first contact point 36, the second contact point CP, or the PCB P. Additionally, when the dome part 32 formed at the switch 30 has a dustproof and waterproof function, even if foreign materials such as dust or moisture enter through the key hole 14, they may not enter the first contact point 36 formed at the electrical terminal part 34. Through this, even if foreign materials enter through the key hole 14, it is possible to prevent the electronic device from being damaged or deteriorated.

Figure 12:
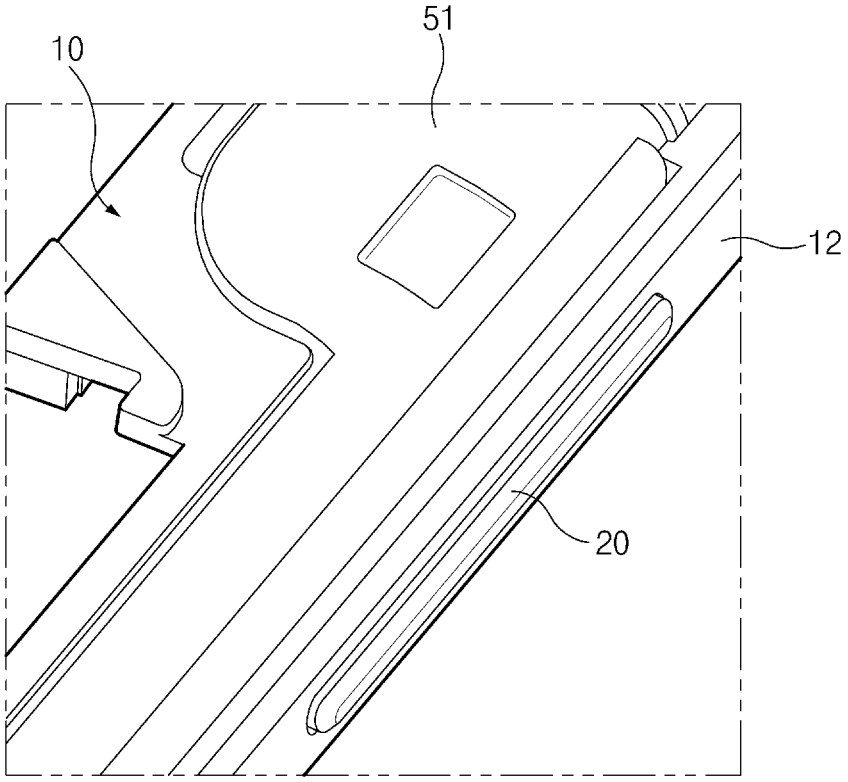
FIG. 12 is a partial perspective view of the electronic device, according to aspects of the disclosure.
Figure 13:
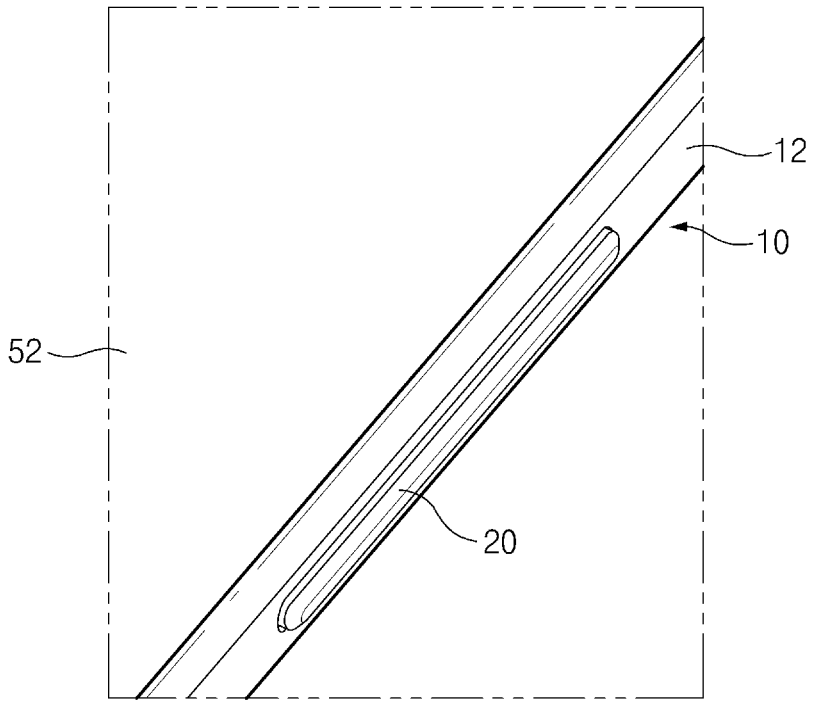
FIG. 13 is a partial perspective view of the electronic device, according to aspects of the disclosure.
Figure 14:
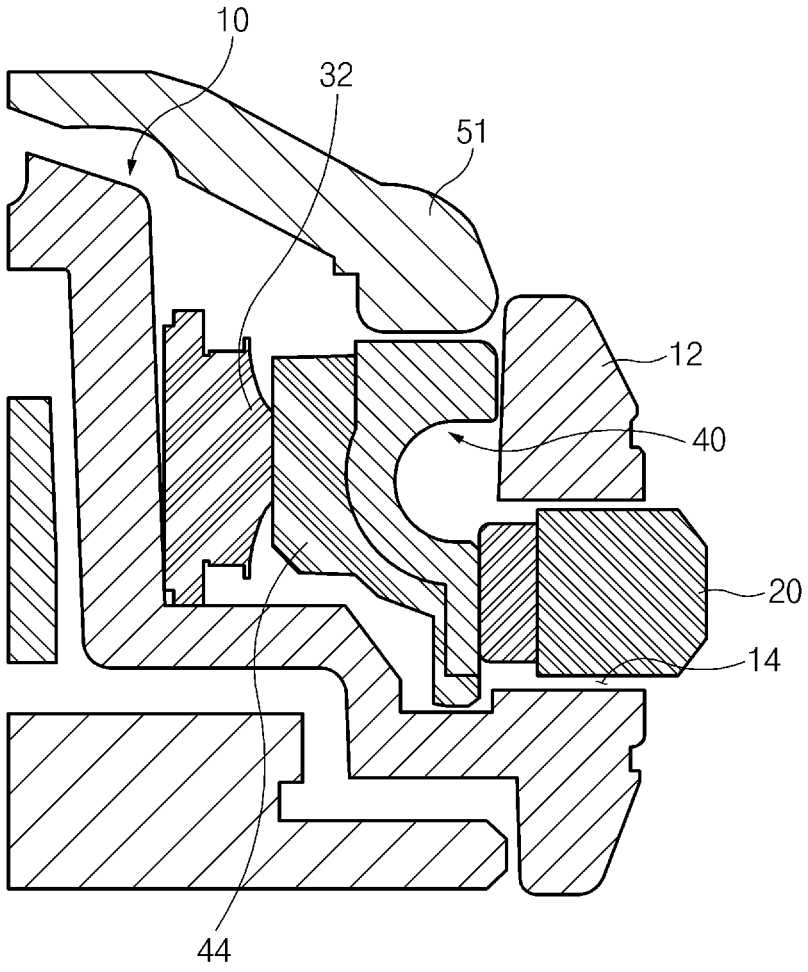
FIG. 14 is a sectional view taken along a line II-II of FIG. 6 of the electronic device, according to aspects of the disclosure.

Referring to FIGS. 12-14, an electronic device according to aspects of the disclosure includes a first cover 51 coupled to the housing 10. The first cover 51 may cover the receiving slot 16 and the seating base 19.

The first cover 51 may prevent the pressing element 40 from being withdrawn from the receiving slot 16 and also may prevent the side key 20 from being withdrawn from the receiving slot 16.

Additionally, referring to FIG. 13, the electronic device may further include a second cover 52 coupled to the housing 10. The second cover 52 may cover the first cover 51 and may form at least a portion of the surface of the housing 10. In some implementations, the second cover 52 may be a battery cover.

Figure 15:
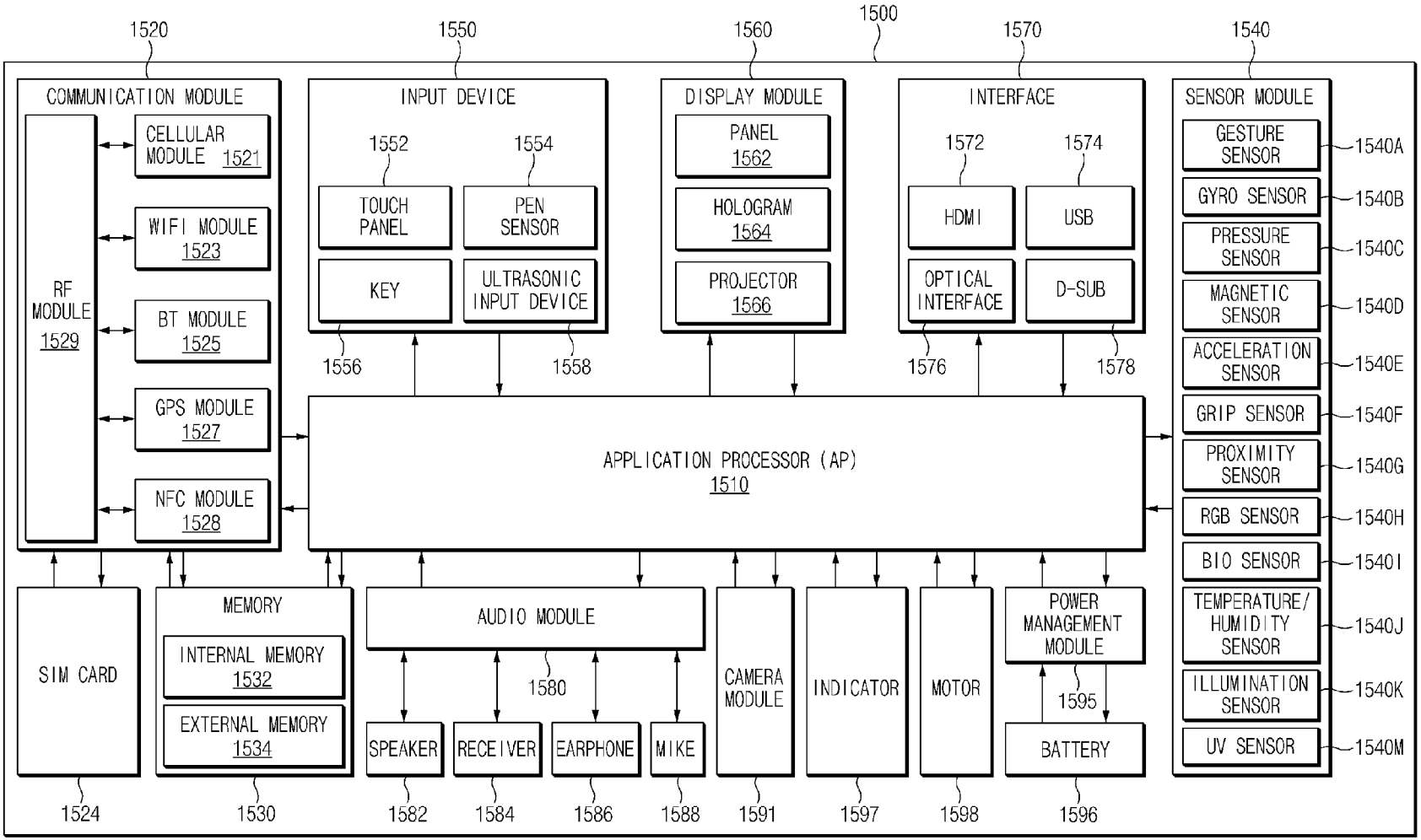
FIG. 15 is a block diagram of the electronic device, according to aspects of the disclosure.

FIG. 15 is a block diagram illustrating an example of an electronic device, according to aspects of the disclosure. The electronic device 1501, for example, may configure all or part of the above-mentioned electronic device. Referring to FIG. 15, the electronic device 1501 includes at least one application processor (AP) 1510, a communication module 1520, a subscriber identification module (SIM) card 1524, a memory 1530, a sensor module 1540, an input device 1550, a display 1560, an interface 1570, an audio module 1580, a camera module 1591, a power management module 1595, a battery 1596, an indicator 1597, and a motor 1598.

The AP 1510 may control a plurality of hardware or software components connected to the AP 1510 and also may perform various data processing and operations with multimedia data by executing an operating system or an application program. The AP 1510 may be implemented with a system on chip (SoC), for example. According to aspects of the disclosure, the processor 1510 may further include a graphic processing unit (GPU) (not shown).

The communication module 1520 may perform data transmission in a communication between the electronic device 1501 and other electronic devices connected thereto through a network. According to aspects of the disclosure, the communication module 1520 may include a cellular module 1521, a Wifi module 1523, a BT module 1525, a GPS module 1527, an NFC module 1528, and a radio frequency (RF) module 1529.

The cellular module 1521 may provide voice calls, video calls, text services, or internet services through a communication network (for example, LTE, LTE-A, CDMA, WCDMA, UMTS, WiBro, or GSM). The cellular module 1521 may perform a distinction and authentication operation on an electronic device in a communication network by using a subscriber identification module (for example, the SIM card 1524), for example. According to aspects of the disclosure, the cellular module 1521 may perform at least part of a function that the AP 1510 provides. For example, the cellular module 1521 may perform at least part of a multimedia control function.

According to aspects of the disclosure, the cellular module 1521 may further include a communication processor (CP). Additionally, the cellular module 1521 may be implemented with SoC, for example.

According to aspects of the disclosure, the AP 1510 or the cellular module 1521 (for example, a CP) may load instructions or data, which are received from a nonvolatile memory or at least one of other components connected thereto, into a volatile memory and then may process them. Furthermore, the AP 1510 or the cellular module 1521 may store data received from or generated by at least one of other components in a nonvolatile memory.

Each of the Wifi module 1523, the BT module 1525, the GPS module 1527, and the NFC module 1528 may include a processor for processing data transmitted/received through a corresponding module.

According to aspects of the disclosure, at least part (for example, more than two) of the cellular module 1521, the Wifi module 1523, the BT module 1525, the GPS module 1527, or the NFC module 1528 may be included one integrated chip (IC) or an IC package. For example, at least some (for example, a CP corresponding to the cellular module 1521 and a Wifi processor corresponding to the Wifi module 1523) of the cellular module 1525, the Wifi module 1527, the BT module 1528, the GPS module 1521, and the NFC module 1523 may be implemented with one SoC.

The RF module 1529 may be responsible for data transmission, for example, the transmission of an RF signal. Although not shown in the drawings, the RF module 1529 may include a transceiver, a power amp module (PAM), a frequency filter, or a low noise amplifier (LNA). Additionally, the RF module 1529 may further include components for transmitting/receiving electromagnetic waves on a free space in a wireless communication, for example, conductors or conducting wires.

According to aspects of the disclosure, at least one of the cellular module 1521, the Wifi module 1523, the BT module 1525, the GPS module 1527, or the NFC module 1528 may perform RF signal transmission through an additional RF module.

The SIM card 1524 may be a card including a subscriber identification module and may be inserted into a slot formed at a specific position of an electronic device. The SIM card 1524 may include unique identification information (for example, an integrated circuit card identifier (ICCID)) or subscriber information (for example, an international mobile subscriber identity (IMSI)).

The memory 1530 may include an internal memory 1532 or an external memory 1534. The internal memory 1532 may include at least one of a volatile memory (for example, dynamic RAM (DRAM), static RAM (SRAM), synchronous dynamic RAM (SDRAM)) and a non-volatile memory (for example, one time programmable ROM (OTPROM), programmable ROM (PROM), erasable and programmable ROM (EPROM), electrically erasable and programmable ROM (EEPROM), mask ROM, flash ROM, NAND flash memory, and NOR flash memory).

According to aspects of the disclosure, the internal memory 1532 may be a Solid State Drive (SSD). The external memory 1534 may further include flash drive, for example, compact flash (CF), secure digital (SD), micro secure digital (Micro-SD), mini secure digital (Mini-SD), extreme digital (xD), or memory stick. The external memory 1534 may be functionally connected to the electronic device 1501 through various interfaces. According to aspects of the disclosure, the electronic device 1501 may further include a storage device (or a storage medium) such as a hard drive.

The sensor module 1540 measures physical quantities or detects an operating state of the electronic device 1501, thereby converting the measured or detected information into electrical signals. The sensor module 1540 may include at least one of a gesture sensor 1540A, a gyro sensor 1540B, a pressure sensor 1540C, a magnetic sensor 1540D, an acceleration sensor 1540E, a grip sensor 1540F, a proximity sensor 1540G, a color sensor 1540H (for example, a red, green, blue (RGB) sensor), a bio sensor 1540I, a temperature/humidity sensor 1540J, an illumination sensor 1540K, and an ultra violet (UV) sensor 1540M. Additionally/alternately, the sensor module 1540 may include an E-nose sensor (not shown), an electromyography (EMG) sensor, an electroencephalogram (EEG) sensor (not shown), an electrocardiogram (ECG) sensor (not shown), an infra red (IR) sensor (not shown), an iris sensor (not shown), or a fingerprint sensor (not shown). The sensor module 1540 may further include a control circuit for controlling at least one sensor therein.

The input module 1550 may include a touch panel 1852, a (digital) pen sensor 1554, a key 1556, or an ultrasonic input device 1558. The touch panel 1552 may recognize a touch input through at least one of capacitive, resistive, infrared, or ultrasonic methods, for example. Additionally, the touch panel 1552 may further include a control circuit. In the case of the capacitive method, both direct touch and proximity recognition are possible. The touch panel 1552 may further include a tactile layer. In this case, the touch panel 1552 may provide a tactile response to a user.

The (digital) pen sensor 1554 may be implemented through a method similar or identical to that of receiving a user's touch input or an additional sheet for recognition. The key 1556 may include a physical button, a touch key, an optical key, or a keypad, for example. The ultrasonic input device 1558, as a device checking data by detecting sound waves through a mike (for example, the mike 1588) in the electronic device 1501, may provide wireless recognition through an input tool generating ultrasonic signals. According to aspects of the disclosure, the electronic device 1501 may receive a user input from an external device (for example, a computer or a server) connected to the electronic device 901 through the communication module 1520.

The display 1560 may include a panel 1562, a hologram device 1564, or a projector 1566. The panel 1562, for example, may include a liquid-crystal display (LCD) or an active-matrix organic light-emitting diode (AM-OLED). The panel 1562 may be implemented to be flexible, transparent, or wearable, for example. The panel 1562 and the touch panel 1552 may be configured with one module. The hologram 1564 may show three-dimensional images in the air by using the interference of light. The projector 1566 may display an image by projecting light on a screen. The screen, for example, may be placed inside or outside the electronic device 1501. According to aspects of the disclosure, the display 1560 may further include a control circuit for controlling the panel 1562, the hologram device 1564, or the projector 1566.

The interface 1570 may include a high-definition multimedia interface (HDMI) 1572, a universal serial bus (USB) 1574, an optical interface 1576, or a D-subminiature (sub) 1578, for example. The interface 1570 may include a mobile high-definition link (MHL) interface, a secure Digital (SD) card/multi-media card (MMC) interface, or an infrared data association (IrDA) standard interface.

The audio module 1580 may convert sound and electrical signals in both directions. The audio module 1580 may process sound information inputted/outputted through a speaker 1582, a receiver 1584, an earphone 1586, or a mike 1588.

The camera module 1591, as a device for capturing a still image and a video, may include at least one image sensor (for example, a front sensor or a rear sensor), a lens (not shown), an image signal processor (ISP) (not shown), or a flash (not shown) (for example, an LED or a xenon lamp).

The power management module 1595 may manage the power of the electronic device 1501. Although not shown in the drawings, the power management module 1595 may include a power management integrated circuit (PMIC), a charger integrated circuit (IC), or a battery or fuel gauge, for example.

The PMIC may be built in an IC or SoC semiconductor, for example. A charging method may be classified into a wired method and a wireless method. The charger IC may charge a battery and may prevent overvoltage or overcurrent flow from a charger. According to aspects of the disclosure, the charger IC may include a charger IC for at least one of a wired charging method and a wireless charging method. As the wireless charging method, for example, there is a magnetic resonance method, a magnetic induction method, or an electromagnetic method. An additional circuit for wireless charging, for example, a circuit such as a coil loop, a resonant circuit, or a rectifier circuit, may be added.

The battery gauge may measure the remaining amount of the battery 1596, or a voltage, current, or temperature of the battery 396 during charging. The battery 1596 may store or generate electricity and may supply power to the electronic device 1501 by using the stored or generated electricity. The battery 1596, for example, may include a rechargeable battery or a solar battery.

The indicator 1597 may display a specific state of the electronic device 1501 or part thereof (for example, the AP 1510), for example, a booting state, a message state, or a charging state. The motor 1598 may convert electrical signals into mechanical vibration. Although not shown in the drawings, the electronic device 1501 may include a processing device (for example, a GPU) for mobile TV support. A processing device for mobile TV support may process media data according to the standards such as digital multimedia broadcasting (DMB), digital video broadcasting (DVB), or media flow.

According to aspects of the disclosure, since a pressing element is disposed between an input button and a switch and a push operation of the input button is applied to the switch by the rotating movement of the pressing element, the switch accurately interoperates with the push operation of the input button to be pressed.

Additionally, according to aspects of the disclosure, a pressing element may be formed of a deformable material by elasticity and since the pressing element presses an input button in an outer direction of a button hole while the input button is not pressed, the input button may not jitter while being inserted into the button hole.

Each of the above-mentioned components of the electronic device according to aspects of the disclosure may be configured with at least one component and the name of a corresponding component may vary according to the kind of an electronic device. An electronic device according to aspects of the disclosure may be configured including at least one of the above-mentioned components or additional other components. Additionally, some components of an electronic device according to aspects of the disclosure may be combined and configured as one entity, so that functions of previous corresponding components are performed identically.

The term "module" used in this disclosure, for example, may mean a unit including a combination of at least one of hardware, software, and firmware. The term "module" and the term "unit", "logic", "logical block", "component", or "circuit" may be interchangeably used. The term "module" may be a minimum unit or part of an integrally configured component. The term "module" may be a minimum unit performing at least one function or part thereof. The term "module" may be implemented mechanically or electronically. For example, "module" used in this disclosure may include at least one of an application-specific integrated circuit (ASIC) chip performing certain operations, field-programmable gate arrays (FPGAs), or a programmable-logic device, all of which are known or to be developed in the future.

According to aspects of the disclosure, at least part of a device (for example, modules or functions thereof) or a method (for example, operations) according to this disclosure, for example, as in a form of a programming module, may be implemented using an instruction stored in computer-readable storage media. When at least one processor executes an instruction, it may perform a function corresponding to the instruction. At least part of a programming module may include a module, a program, a routine, sets of instructions, or a process to perform at least one function, for example.

FIGS. 1-15 are provided as an example only. It will be understood that the provision of the examples described herein, as well as clauses phrased as "such as," "e.g.", "including", "in some aspects," "in some implementations," and the like should not be interpreted as limiting the claimed subject matter to the specific examples.

The above-described aspects of the present disclosure can be implemented in hardware, firmware or via the execution of software or computer code that can be stored in a recording medium such as a CD-ROM, a Digital Versatile Disc (DVD), a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

While the present disclosure has been particularly shown and described with reference to the examples provided therein, it will be understood by those skilled in the art that various changes in form and details may be made therein without departing from the spirit and scope of the present disclosure as defined by the appended claims.

What is claimed is:

1. An electronic device comprising:

a housing having a button hole formed therein:

a button disposed in the button hole;

a switch having a first touch part and a second touch part; and a pressing element interposed between the button and the switch, the pressing element including a first end part contacting a first wall of the housing, a second end part contacting the button, a first pressing projection disposed adjacently to the first touch part, a third end part contacting the first wall of the housing, a forth end part contacting the button, and a second pressing projection disposed adjacently to the second touch part;

wherein when one side of the button is actuated, the second end part pivots upon the first end part in a first direction, while the first pressing projection actuates the first touch part, wherein the first end part is aligned with the first wall and a dome of the first touch part along a first axis and the second end part is aligned with the dome of the first touch part and the button along a second axis, wherein the first axis and the second axis are substantially parallel to one another, wherein when an other side of the button is actuated, the forth end part pivots upon the third end part in the first direction, while the second pressing projection actuates the second touch part, wherein the third end part is aligned with the first wall and a dome of the second touch part along a third axis and the forth end part is aligned with the dome of the second touch part and the button along a forth axis, and wherein the third axis and the forth axis are substantially parallel to one another.

2. The electronic device according to claim 1, wherein the button hole is formed in the first wall.

3. The electronic device according to claim 1, wherein each of the first pressing projection and the second pressing projection has a convex shape.

4. The electronic device according to claim 1, wherein the first end part includes at least one of rotation center projection, and the pressing element pivots about the at least one of rotation center projection when the button is actuated.

5. The electronic device according to claim 4, wherein the at least one of rotation center projection includes a curved surface that rolls onto the first wall when the button is actuated.

6. The electronic device according to claim 1, wherein the pressing element includes a reinforcing rib facing the first wall of the housing.

7. The electronic device according to claim 6, wherein the reinforcing rib is formed along a direction connecting the first end part and the second end part.

8. The electronic device according to claim 1, wherein the switch is disposed inside a receiving slot formed inside the housing.

9. The electronic device according to claim 8, wherein both end parts of the pressing element are fixed in the receiving slot.

10. The electronic device according to claim 8, wherein the receiving slot includes a receiving groove formed at a bottom of the receiving slot, and each of the second end part and the forth end part is at least partially disposed inside the receiving groove.

11. The electronic device according to claim 1, wherein the button includes a protrusion facing the switch, and the button performs a seesaw movement as a result of the protrusion.

12. The electronic device according to claim 1, wherein the button includes a base formed of an elastically deformable material.

13. The electronic device according to claim 1, wherein the pressing element is formed of an elastically deformable material.

14. The electronic device according to claim 13, wherein the pressing element is an injection product of a single material or a double injection product of different materials.

15. The electronic device according to claim 1, further comprising: a receiving slot formed inside the housing; and a seating base formed adjacently to the receiving slot, wherein the switch includes a terminal part disposed in the seating base.

16. The electronic device according to claim 15, wherein the switch further includes a dome part that is transverse to the terminal part, the dome part being disposed inside the receiving slot.

17. The electronic device according to claim 16, wherein the dome part substantially faces the first wall and the terminal part substantially faces a second wall of the housing that neighbors the first wall.

18. The electronic device of claim 17, further comprising a contact point disposed inside the seating base.

19. The electronic device of claim 18, wherein the terminal part of the switch is adhered to the seating base via a waterproofing material.

20. The electronic device of claim 19, wherein the waterproofing material includes a waterproofing tape.

* * * * *